US009817344B2

(12) United States Patent
Yotsutsuji et al.

(10) Patent No.: US 9,817,344 B2
(45) Date of Patent: Nov. 14, 2017

(54) FIXING DEVICE CAPABLE OF SENSING TEMPERATURE OF HEATING BODY OUTSIDE FRAME SURROUNDING HEATING BODY REGARDLESS OF MOVING FRAME AND IMAGE FORMING APPARATUS INCLUDING THIS FIXING DEVICE

(71) Applicant: KYOCERA Document Solutions Inc., Osaka (JP)

(72) Inventors: Takefumi Yotsutsuji, Osaka (JP); Yoshihiro Yamagishi, Osaka (JP); Takashi Eiki, Osaka (JP); Kotatsu Kawaguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/271,663

(22) Filed: Sep. 21, 2016

(65) Prior Publication Data

US 2017/0090364 A1 Mar. 30, 2017

(30) Foreign Application Priority Data

Sep. 25, 2015 (JP) ..... 2015-188418

(51) Int. Cl.
*G03G 15/20* (2006.01)

(52) U.S. Cl.
CPC ..... *G03G 15/2039* (2013.01); *G03G 15/2064* (2013.01)

(58) Field of Classification Search
CPC ..... G03G 15/2032; G03G 15/2039
USPC ..... 399/69, 122
See application file for complete search history.

(56) References Cited

U.S. PATENT DOCUMENTS 4,821,069 A * 4/1989 Kusumoto ..... G03G 15/2039 219/216
6,795,680 B2 * 9/2004 Yokoi et al. ..... G03G 15/2057 399/69
7,433,619 B2 * 10/2008 Suzuki et al. ..... G03G 15/2039 399/69
8,718,502 B2 * 5/2014 Yuasa et al. ..... G03G 15/2039 399/69

FOREIGN PATENT DOCUMENTS

JP 2009-053245 A 3/2009

* cited by examiner

*Primary Examiner* — William J Royer
(74) *Attorney, Agent, or Firm* — Studebaker & Brackett PC

(57) ABSTRACT

A fixing device includes a heating body, a pressuring body, a temperature detecting part, a first frame supporting the heating body, a second frame supporting the pressuring body and a moving mechanism. The temperature detecting part has a detecting element detecting an infrared ray radiated from the heating body and detects temperature of the heating body by the detecting element. The first frame includes a heat interrupting member covering the heating body between the heating body and the temperature detecting part. The moving mechanism moves the first frame in an approaching direction or a separating direction from the second frame to establish the heating body and the pressuring body in a pressurization state or a depressurization state. The heat interrupting member includes an aperture elongated in a movement direction of the first frame to pass the infrared ray radiated from the heating body to the detecting element through the aperture.

12 Claims, 8 Drawing Sheets

FIXING DEVICE CAPABLE OF SENSING TEMPERATURE OF HEATING BODY OUTSIDE FRAME SURROUNDING HEATING BODY REGARDLESS OF MOVING FRAME AND IMAGE FORMING APPARATUS INCLUDING THIS FIXING DEVICE

INCORPORATION BY REFERENCE

This application is based on and claims the benefit of priority from Japanese Patent application No. 2015-188418 filed on Sep. 25, 2015, the entire contents of which are incorporated herein by reference.

BACKGROUND

The present disclosure relates to a fixing device for fixing a toner image to a recording medium and an image forming apparatus including the fixing device.

An image forming apparatus of an electrographic manner, such as a copying machine or a printer, includes a fixing device for fixing a toner image to a recording medium, such as a sheet.

For example, there is known a fixing device in which a fixing roller (a heating body) coming into direct contact with a pressuring roller (a pressuring body) to thereby form a fixing nip is configured as a heating member heated by an electromagnetic induction heating means. In this fixing device, the fixing roller is provided with a heating layer heated by the electromagnetic induction heating means, and then, the fixing roller is directly heated and a thermopile (an infrared ray detecting element) is provided integrally with a coil guide. Incidentally, in the coil guide, a cylindrical part in which a through hole for mounting has been formed is provided, and then, the thermopile is fitted into the hole of the cylindrical part and the hole is closed.

In the fixing device in which the pressuring body and the heating body come into direct contact with each other to thereby form the fixing nip, a first frame supporting the heating body may be approached to or separated from a second frame supporting the pressuring body, and thereby, pressurization or depressurization between the pressuring body and the heating body can be switched.

In the fixing device configured so that the thermopile (the infrared ray detecting element) is fitted into the cylindrical part, in a case where a mounting position of the thermopile is even slightly displaced, a path leading up to the thermopile of the infrared ray generated from the heating body may be interrupted by an inside wall of the cylindrical part, that is, the inside wall may conceal a detection range (a field of view) of the thermopile.

In addition, in order to reduce an apparatus construction for the sake of downsizing and space saving of the fixing device, it is necessary to install the thermopile at an upper part of the heating body as mentioned above. However, the thermopile installed at the upper part is prone to be influenced by a convection heat from the heating body, and accordingly, there is a possibility of mistaken detection of temperature. In particular, in the fixing device having the above-mentioned configuration, because the thermopile closes the hole of the cylindrical part, the convection heat (or a radiant heat) generated from the heating body stays in the cylindrical part, and accordingly, there is a possibility that the temperature detected by the thermopile is shifted from an actual temperature.

Further, as mentioned above, in the fixing device configured so that the first frame supporting the heating body is approached to or separated from the second frame supporting the pressuring body, if the thermopile is fixed to the movable first frame, there is a possibility that a failure, such as disconnection, of wiring of the thermopile occurs. Furthermore, if the coil guide into which the thermopile is fitted is provided independently from the movable first frame, because the heating body is moved together with the first frame, the detection position by the thermopile is shifted, and accordingly, there is a possibility that the heat of the heating body cannot be appropriately detected.

Incidentally, in order to prevent the convection heat of the heating body from having an influence on the thermopile, there is a case where the first frame may be constructed as a heat interrupting member between the heating body and the thermopile. In this case, an aperture for causing the infrared ray radiated from the heating body to pass therethrough is provided in the first frame and the thermopile is arranged to face to the heating body across the aperture. However, because the first frame is moved in order to switch depressurization or depressurization between the pressuring body and the heating body, the position of the aperture is shifted from the thermopile, and accordingly, there is a possibility that the thermopile cannot appropriately detect the heat of the heating body.

Thus, if the heat of the heating body cannot be appropriately detected, there is a possibility that high temperature of the heating body cannot be detected and the heating body is overheated, and moreover, there is also a possibility of firing.

SUMMARY

In accordance with an embodiment of the present disclosure, a fixing device includes a heating body, a pressuring body, a temperature detecting part, a first frame, a second frame and a moving mechanism. A surface of the heating body is heated by a heat source. The pressuring body is brought into pressure contact with the heating body to form a fixing nip. The temperature detecting part is arranged with respect to the heating body in a noncontact manner, provided with an infrared ray detecting element detecting an infrared ray radiated from the surface of the heating body and configured to detect surface temperature of the heating body on the basis of a result of detection by the infrared ray detecting element. The first frame is configured to support the heating body in a rotatable state and to include a heat interrupting member provided between the heating body and the temperature detecting part so as to cover the heating body. The second frame is configured to support the pressuring body in a rotatable state. The moving mechanism is configured to move the first frame in an approaching direction with respect to the second frame to establish the heating body and the pressuring body in a pressurization state and to move the first frame in a separating direction with respect to the second frame to establish the heating body and the pressuring body in a depressurization state. The heat interrupting member includes an aperture having an elongated shape in a movement direction of the first frame and causing the infrared ray radiated from the heating body to pass therethrough to the infrared ray detecting element.

In accordance with an embodiment of the present disclosure, an image forming apparatus includes the above-mentioned fixing part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
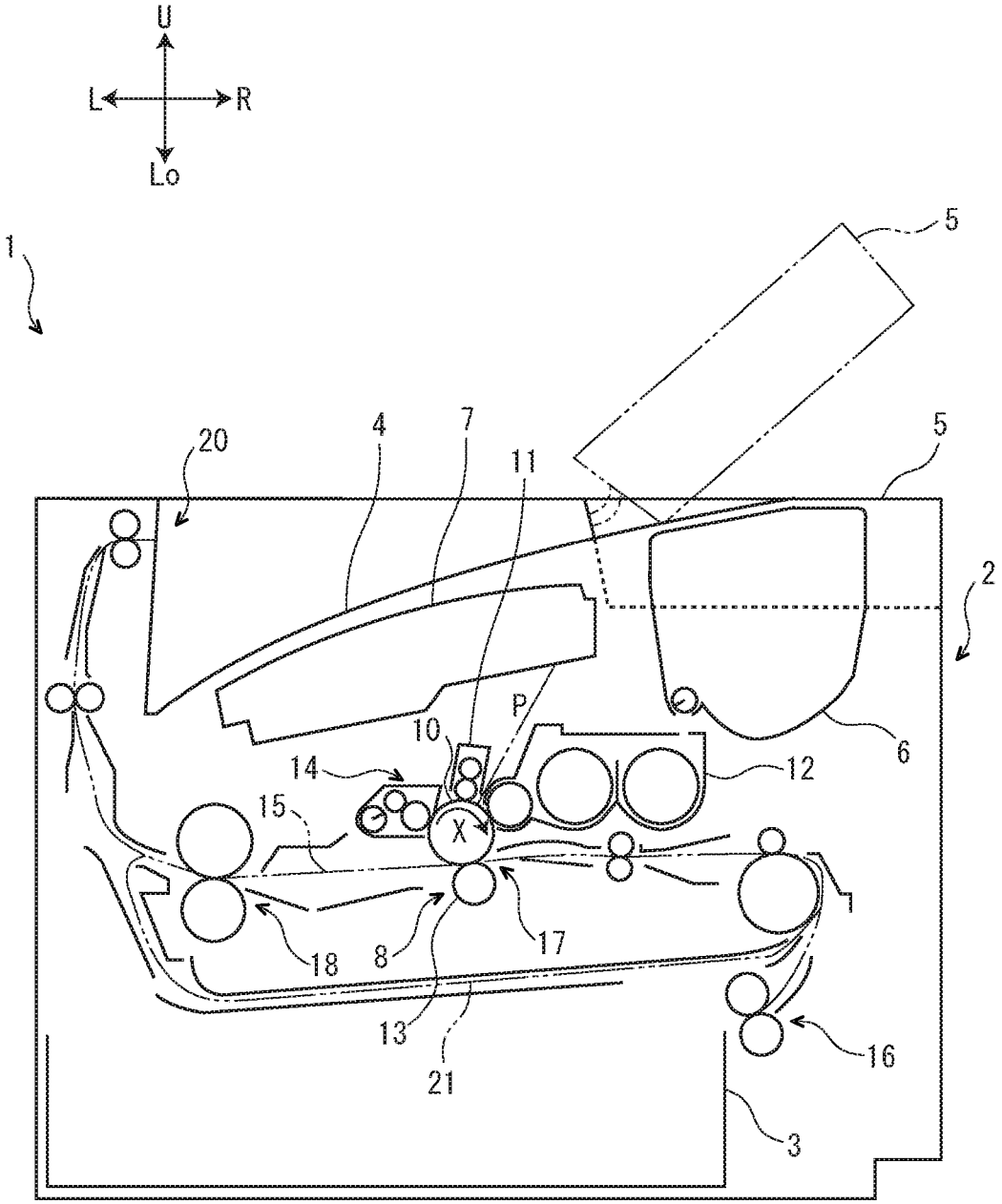
FIG. 1 is a sectional view schematically showing a printer according to an embodiment of the present disclosure.

First, with reference to FIG. 1, the entire structure of a printer 1 (an image forming apparatus) will be described. Arrows Fr, Rr, L, R, U and Lo in each of the drawings respectively indicate a front side, a rear side, a left side, a right side, an upper side and a lower side of the printer 1.

The printer 1 includes a box-like formed printer main body 2. In a lower part of the printer main body 2, a sheet feeding cartridge 3 storing sheets (recording mediums) is installed. In an upper face of the printer main body 2, an ejected sheet tray 4 is formed. In the upper face of the printer main body 2, an upper cover 5 is openably/closably attached at a lateral side of the ejected sheet tray 4. Below the upper cover 5, a toner container 6 is installed.

In an upper part inside the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charging device 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end of the conveying path 15, a sheet feeding part 16 is positioned. At an intermediate stream part of the conveying path 15, a transferring part 17 composed of the photosensitive drum 10 and transfer roller 13 is positioned. At a downstream part of the conveying path 15, a fixing device 18 is positioned. At a downstream end of the conveying path 15, a sheet ejecting part 20 is positioned. Below the conveying path 15, an inversion path 21 for duplex printing is arranged.

Next, image forming operation of the printer 1 including such a configuration will be described.

When the power is supplied to the color printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charging device 11. Then, photographic exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. The electrostatic latent image is developed to a toner image with a toner by the development device 12.

On the other hand, the sheet picked up from the sheet feeding cartridge 3 by the sheet feeding part 16 is conveyed to the transferring part 17 in a suitable timing for the above-mentioned image forming operation. In the transferring part 17, the toner image on the photosensitive drum 10 is transferred onto the sheet. The sheet with the transferred toner image is conveyed to a downstream side in the conveying path 15 to go into the fixing device 18. In the fixing device 18, the toner image is fixed on the sheet. The sheet with the fixed toner image is ejected from the sheet ejecting part 20 to the sheet ejected tray 4. Incidentally, the toner remained on the photosensitive drum 10 is collected by the cleaning device 14.

Next, the fixing device 18 will be described with reference to FIG. 2 to FIG. 9.

Figure 2:
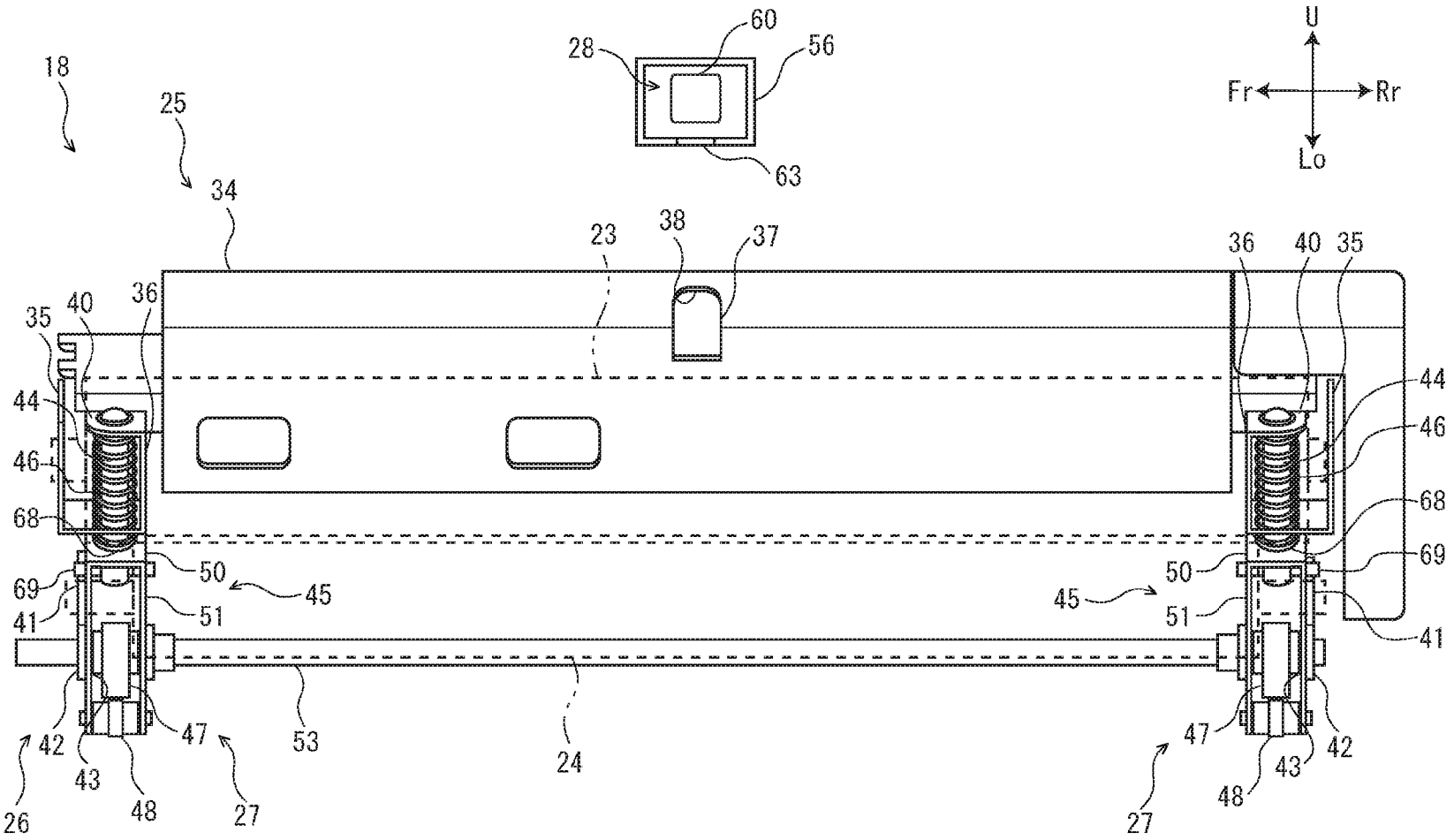
FIG. 2 is a side view showing a fixing device according to the embodiment of the present disclosure.
Figure 3:
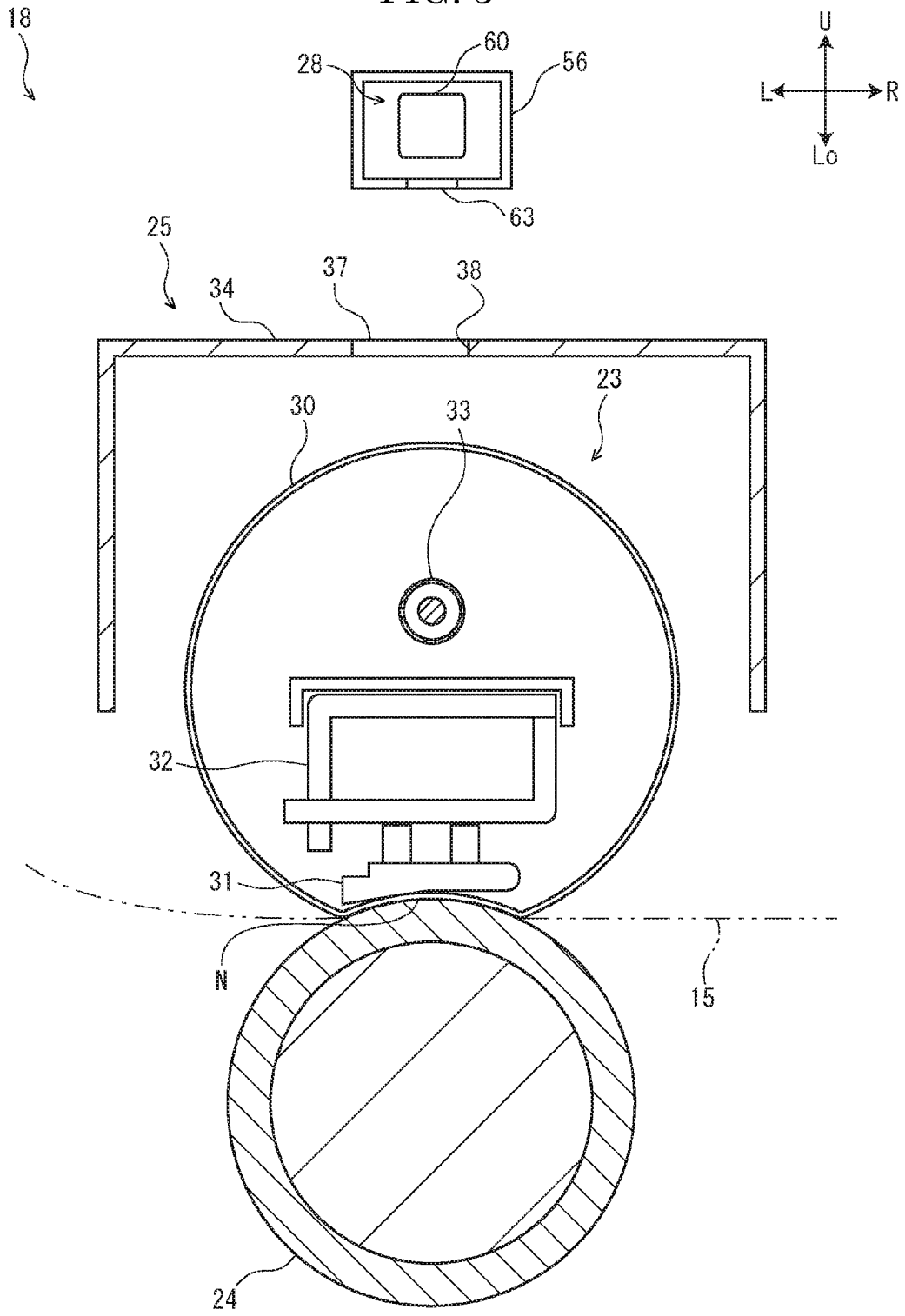
FIG. 3 is a sectional view showing the fixing device according to the embodiment of the present disclosure.

As shown in FIG. 2, FIG. 3 and other figures, the fixing device 18 includes a heating body 23 and a pressuring body 24 respectively disposed at an upper side and a lower side across the conveying path 15. Also, the fixing device 18 includes a first frame 25 supporting the heating body 23, a second frame 26 supporting the pressuring body 24 and two moving mechanisms 27 to move the first frame 25 (the heating body 23) in an approaching direction/a separating direction with respect to the second frame 26 (the pressuring body 24) (refer to FIG. 4, FIG. 5 and other figures). In the embodiment, the approaching direction of the first frame 25 (the heating body 23) (hereinafter, simply called as the "approaching direction") is a lower left direction and the separating direction of the first frame 25 (the heating body 23) (hereinafter, simply called as the "separating direction") is an upper right direction. That is, the first frame 25 (the heating body 23) is moved at least in a sheet conveyance direction (left and right directions). Further, the fixing device 18 includes a temperature detecting part 28 detecting surface temperature of the heating body 23.

The heating body 23 includes a fixing belt 30 formed in a roughly cylindrical shape, a pressing member 31 disposed along a lower side of an inner circumference face of the fixing belt 30, a supporting member 32 disposed above the pressing member 31 inside the fixing belt 30 and a heat source 33 disposed above the supporting member 32 inside the fixing belt 30.

The fixing belt 30 has an elongated shape in a sheet width direction (forward and backward directions) being orthogonal to (crossing) the sheet conveyance direction (the left and right directions) and is rotatably mounted with respect to the first frame 25. When the first frame 25 is approached to the second frame 26, the fixing belt 30 (the heating body 23) is approached to the pressuring body 24, and then, the heating body 23 and the pressuring body 24 are established in the pressurization state and a fixing nip N is formed (refer to FIG. 4). On the other hand, when the first frame 25 is separated from the second frame 26, the fixing belt 30 (the heating body 23) is separated from the pressuring body 24, and then, the heating body 23 and the pressuring body 24 are established in the depressurization state (refer to FIG. 5).

The fixing belt 30 is composed of, for example, a base material layer, an elastic layer provided around the base material layer and a release layer covering the elastic layer and has elasticity. The base material layer of the fixing belt 30 is formed of, for example, nickel electric casting. The elastic layer of the fixing belt 30 is formed of, for example, a silicone rubber. The release layer of the fixing belt 30 is formed of, for example, perfluoro alkoxy alkane (PFA). Incidentally, in each of the figures, the respective layers (the base material layer, the elastic layer, the release layer) of the fixing belt 30 are represented without being distinguished from each other in particular.

The pressing member 31 has an elongated shape in the forward and backward directions. The pressing member 31 is formed of, for example, heat resistant resin, such as LCP (Liquid Crystal Polymer). The pressing member 31 is disposed so that a lower face thereof presses the lower side on the inner circumference face of the fixing belt 30 toward the lower side (the side of the pressuring body 24).

The supporting member 32 is formed in a roughly rectangular cylindrical shape elongated in the forward and backward directions. The supporting member 32 is formed of, for example, metal, such as steel special use stainless (SUS). A lower face of the supporting member 32 abuts against an upper face of the pressing member 31.

The heat source 33 has an elongated shape in the forward and backward directions and is composed of, for example, a halogen lamp, a ceramic heater or the like.

The pressuring body 24 is formed in a roughly cylindrical shape elongated in the forward and backward directions and is rotatably mounted with respect to the second frame 26. The pressuring body 24 is composed of, for example, a pressuring roller or the like. When the pressuring body 24 is brought into pressure contact with the fixing belt 30, the fixing nip N is formed between the fixing belt 30 and the pressuring body 24. At a rear end of the pressuring body 24, a pressuring body driving gear 74 (refer to FIG. 10) is coaxially fixed.

The pressuring body 24 is composed of, for example, a cylindrical core member, an elastic layer provided around the core member and a release layer covering the elastic layer. The core member of the pressuring body 24 is formed of, for example, metal, such as aluminum. The elastic layer of the pressuring body 24 is formed of, for example, a silicone sponge rubber. The release layer of the pressuring body 24 is formed of, for example, a PFA tube. Incidentally, in each of the figures, the respective layers (the core member, the elastic layer, the release layer) of the pressuring body 24 are represented without being distinguished from each other in particular.

The first frame 25 includes a heat interrupting member 34, two heating body supporting parts 35 and two first coupling parts 36. The first frame 25 is movably disposed at the upper part of the fixing device 18 (refer to FIG. 4 and FIG. 5).

The heat interrupting member 34 has an elongated shape in the forward and backward directions and is formed, for example, so as to have an inverted U-shaped cross section. The heat interrupting member 34 is disposed above the heating body 23 so as to cover the heating body 23 from an upper side. In the heat interrupting member 34, an aperture 37 having an elongated shape in a movement direction of the first frame 25 is provided. The aperture 37 causes the infrared ray radiated from the heating body 23 to pass therethrough to a thermopile 60 (an infrared detecting element) of the temperature detecting part 28. For example, in the construction in which the first frame 25 is moved at least in the left and right directions (the sheet conveyance direction) with respect to the second frame 26, the aperture 37 has an elongated in the left and right directions and is formed to penetrate upwardly and downwardly on the upper face of the heat interrupting member 34.

For example, the aperture 37 is formed from a first position A1 (refer to FIG. 8) of the heat interrupting member 34 to a second position A2 (refer to FIG. 9) of the heat interrupting member 34. The first position A1 of the heat interrupting member 34 corresponds to the field of view B (the detection range of infrared ray, refer to FIG. 8) of the temperature detecting part 28 when the heating body 23 is established in the pressurization state. The second position A2 of the heat interrupting member 34 corresponds to the field of view B (the detection rage of infrared ray, refer to FIG. 9) of the temperature detecting part 28 when the heating body 23 is established in the depressurization state. The aperture 37 may preferably be formed in a U-shape having a bottom part 38 at a side of the first position A1 (the sheet input side in the sheet conveyance direction of the conveying path 15) (refer to FIG. 7). Incidentally, the aperture 37 may preferably be formed at a position at which a sheet of the smallest size passes through the fixing device 18, that is, at a roughly center in the forward and backward directions (the sheet width direction).

Two heating body supporting parts 35 have the respective shapes extending downwardly from both ends in the forward and backward directions of the heat interrupting member 34 and are provided integrally with the heat interrupting member 34. The two heating body supporting parts 35 are respectively provided at both sides of the heating body 23 to support the heating body 23 in a rotatable state.

The two first coupling parts 36 are extended continuously from respective right ends of the two heating body supporting parts 35 (the ends at the sheet input side in the sheet conveyance direction of the conveying path 15) and are provided integrally with the two heating body supporting parts 35. Each first coupling part 36 has a shape extending in the movement direction of the first frame 25 (hereinafter, simply called as the "movement direction") and, in the embodiment, has a shape extending from the upper right side in the lower left direction. Each first coupling part 36 includes a coupling shaft tightening part 40 at an end at a separating direction side (at an upper right end). The coupling shaft tightening part 40 has, for example, a through hole (not shown) penetrating in the movement direction and is configured so that, via the through hole, a coupling shaft 44 of the moving mechanism 27 is tightened with screws or the like.

Figure 4:
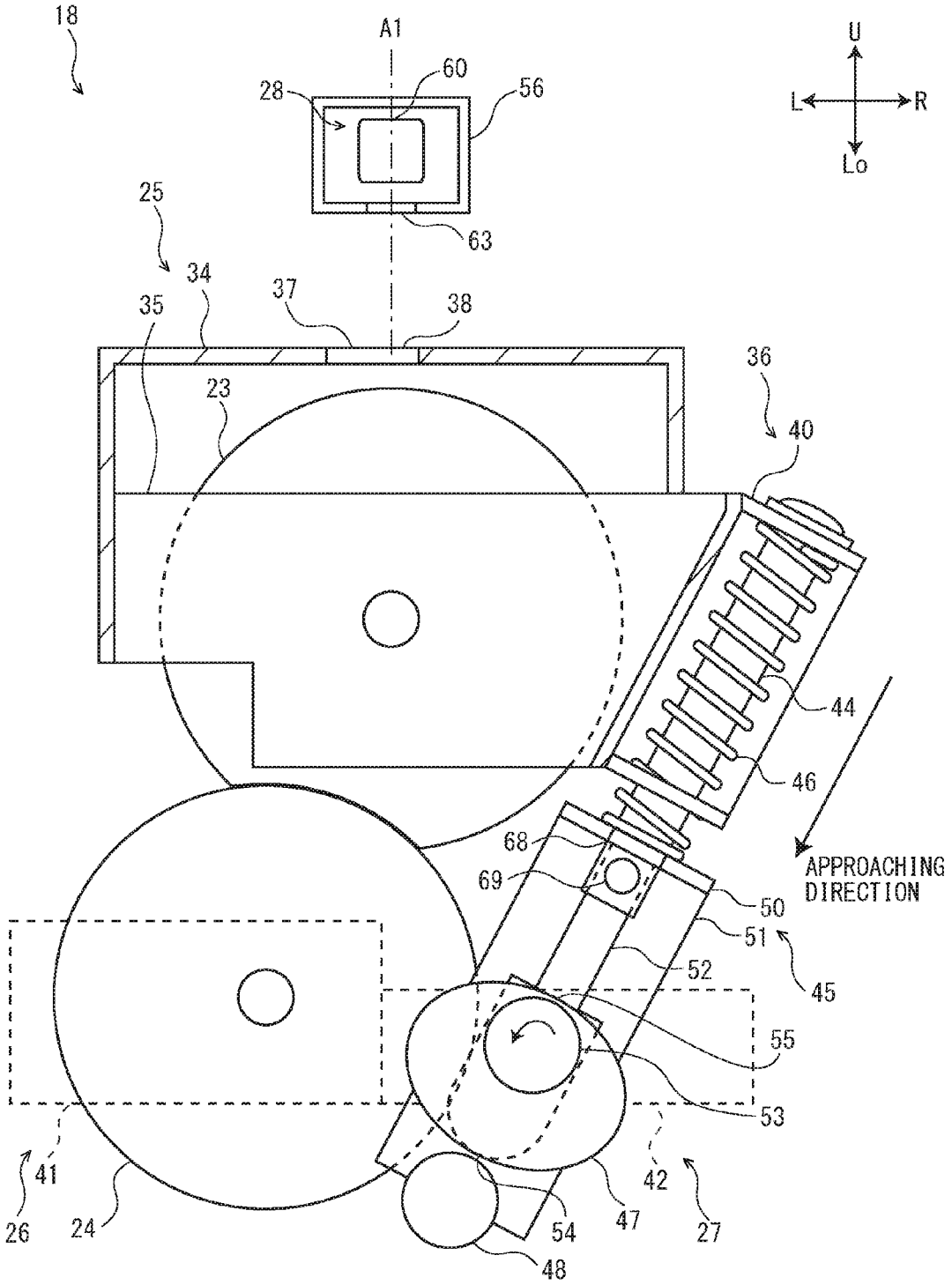
FIG. 4 is a sectional view showing the fixing device in a pressurization state according to the embodiment of the present disclosure.
Figure 5:
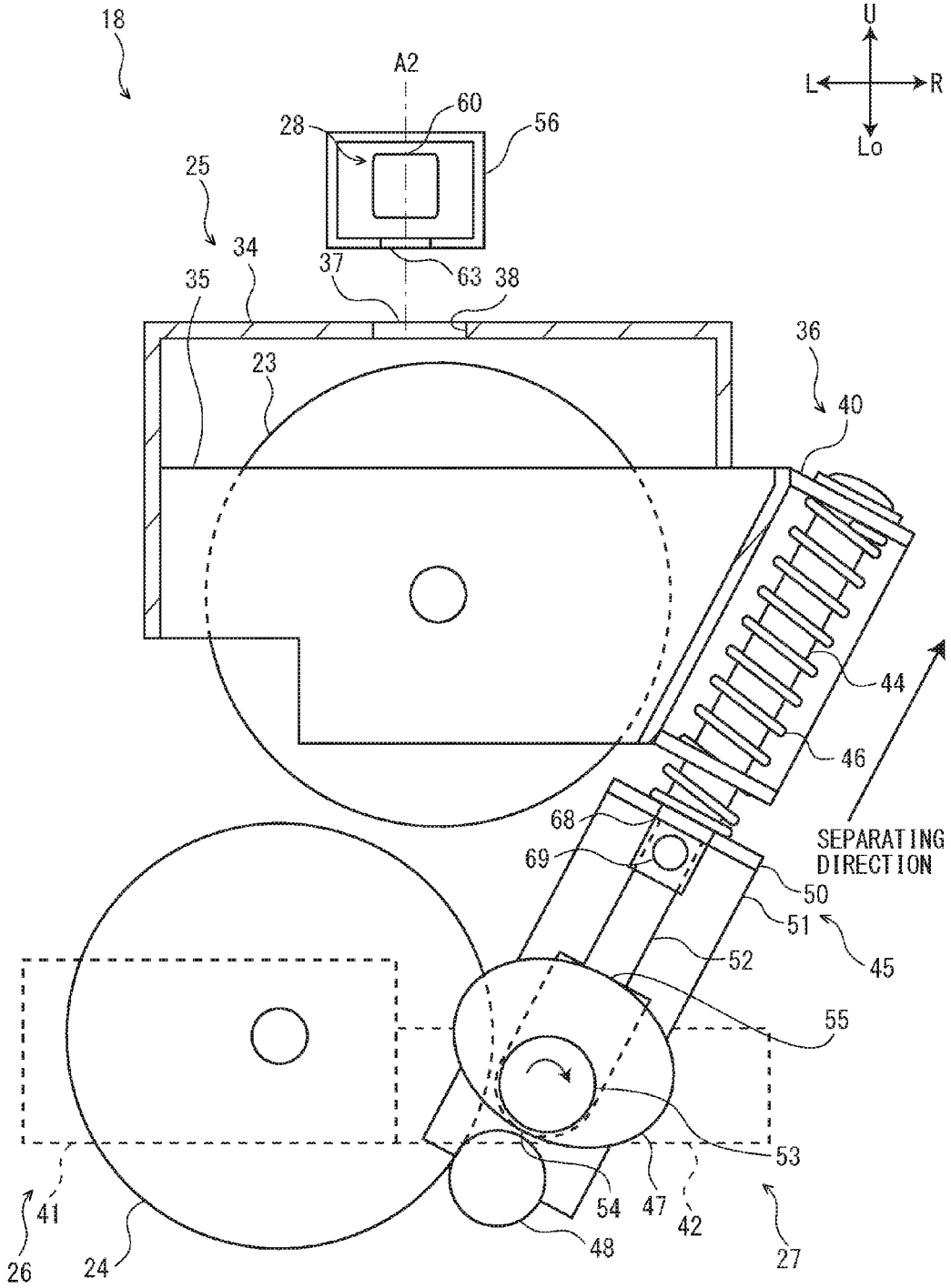
FIG. 5 is a sectional view showing the fixing device in a depressurization state according to the embodiment of the present disclosure.

The second frame 26 includes two pressuring body supporting parts 41 and two second coupling parts 42 and is immovably disposed at the lower part of the fixing device 18 (refer to FIG. 4 and FIG. 5).

The two pressuring body supporting parts 41 are respectively provided at both sides of the pressuring body 24 to support the pressuring body 24 in a rotatable state. The two pressuring body supporting parts 41 are fixed, for example, at both ends in the forward and backward directions of a lower plate (not shown) provided below the pressuring body 24 and provided integrally with the lower plate.

The two second coupling parts 42 are extended continuously from respective right ends of the two pressuring body supporting parts 41 (the ends at the sheet input side in the sheet conveyance direction of the conveying path 15) and are provided integrally with the two pressuring body supporting parts 41. The two second coupling parts 42 are disposed at respective approaching direction sides (the lower left sides) from the two first coupling parts 36. Each second coupling part 42 includes a cam shaft supporting hole 43 and the cam shaft supporting hole 43 is formed to penetrate in the forward and backward directions.

Each moving mechanism 27 includes a coupling shaft 44, a third frame 45, a biasing member 46, a cam 47 and a cam abutment part 48. Each moving mechanism 27 is disposed between each first coupling part 36 of the first frame 25 and each second coupling part 42 of the second frame 26.

Each coupling shaft 44 is formed in a cylindrical shape elongated in the movement direction (the upper right direction and the lower left direction). An upper right end of each coupling shaft 44 (the end at the separating direction side) is fastened to the coupling shaft tightening part 40 of each first coupling part 36 of the first frame 25. A lower left end of each coupling shaft 44 (the end at the approaching direction side) is inserted via a through hole 68 of a upper plate 50 of each third frame 45 and is mounted by a parallel pin 69 or the like caused to pass through a movement gap 52 of each side plate 51 of each third frame 45.

Each third frame 45 is composed of the upper plate 50 and the two side plates 51 and has an elongated shape in the movement direction. The upper plate 50 is provided at the separating direction side (the upper right side) in the third frame 45. Each side plate 51 has a shape extending in the approaching direction (the lower left direction) from each end in the forward and backward directions of the upper plate 50 and, in each side plate 51, the movement gap 52 along the movement direction is formed. The movement gap 52 has a width in which a cam shaft 53 can be inserted in the approaching direction side (the lower left side) and has a smaller width than that of the cam shaft 53 at the separating direction side.

Each biasing member 46 is composed of a spring having an elongated shape in the movement direction or the like and is mounted around each coupling shaft 44. An end at the separating direction side of each biasing member 46 is fixed to a lower face of the coupling shaft tightening part 40 of each first coupling part 36 of the first frame 25 and an end at the approaching direction side of each biasing member 46 is fixed to an upper face of the upper plate 50 of each third frame 45. Thus, each biasing member 46 biases the first frame 25 so as to draw the first frame 25 to the third frame 45. In other words, each biasing member 46 biases the first frame 25 so as to draw the first frame 25 to the second frame 26 to which each third frame 45 is mounted.

Each cam 47 is provided around the cam shaft 53. Each cam 47 has, on an outer circumference face, a pressurization face 54 for establishing the heating body 23 in the pressurization state with respect to the pressuring body 24 and a depressurization face 55 for establishing the heating body 23 in the depressurization state with respect to the pressuring body 24. The cam shaft 53 has an elongated shape in the forward and backward directions and is mounted while being inserted through the cam shaft supporting hole 43 of each second coupling part 42 of the second frame 26 and the movement gaps 52 of the two side plates 51 of each third frame 45. At a front end of the cam shaft 53, a cam driving gear 75 (refer to FIG. 10) is coaxially mounted. When the cam driving gear 75 is rotated by a cam driving source 73 (refer to FIG. 10), such as a motor, each cam 47 provided at the cam shaft 53 is rotated.

Each cam abutment part 48 is disposed at the approaching direction side from each cam 47 and is rotatably mounted to the two side plates 51 of each third frame 45 at the approaching direction side from the movement gap 52. An outer circumference face of each cam abutment part 48 abuts against the outer circumference face of each cam 47.

Figure 6:
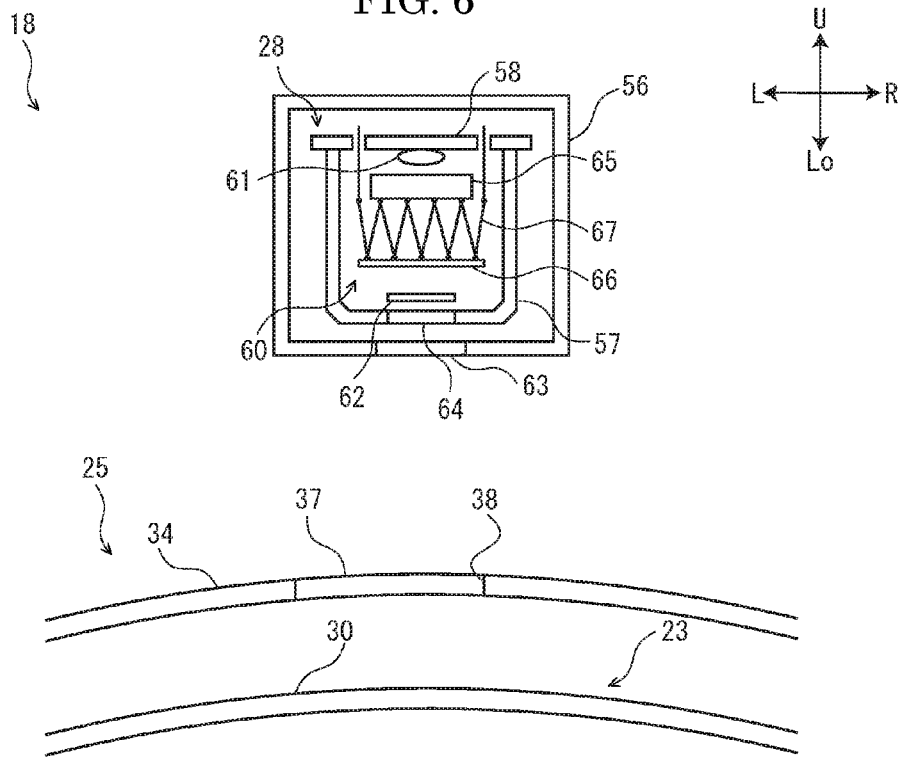
FIG. 6 is a sectional view showing a temperature detecting part of the fixing device according to the embodiment of the present disclosure.
Figure 7:
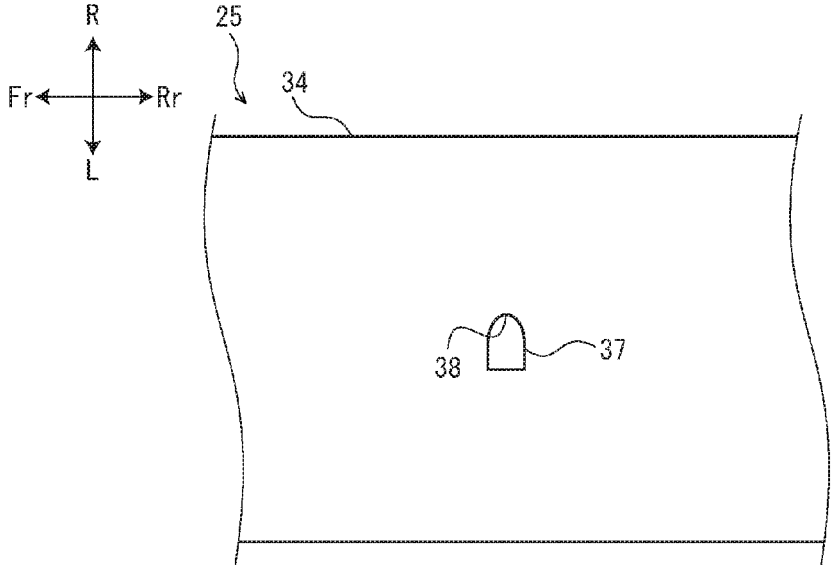
FIG. 7 is a plan view showing a heat interrupting member of the fixing device according to the embodiment of the present disclosure.

The temperature detecting part 28 is mounted inside a holding member 56 and includes a casing 57, a substrate 58, the thermopile 60 (an infrared ray detecting element), an environmental temperature sensor 61 and a lens 62 (refer to FIG. 6).

The holding member 56 is mounted to a main body frame (not shown) of the printer main body 2, a main body frame (not shown) of the fixing device 18 or the like above the heat interrupting member 34 and positions the temperature detecting part 28 with respect to the fixing belt 30 of the heating body 23 in a noncontact manner. The holding member 56 has a roughly box-like shape and, at a roughly center of a lower face thereof, a holding member aperture 63 is formed.

The casing 57 has a roughly cylindrical shape and, at a roughly center of a lower face thereof, a casing aperture 64 is formed. The substrate 58 is disposed so as to close an upper end of the casing 57 and is connected to a controller 70 (refer to FIG. 10) via wiring (not shown).

The thermopile 60 is mounted to a lower face of the substrate 58 inside of the casing 57. The thermopile 60 is composed of a cold contact point 65, a hot contact point 66 and a plurality of thermocouples 67. The cold contact point 65 is provided at an upper part of the thermopile 60 and the hot contact point 66 is provided below the cold contact point 65 at a predetermined interval. Each thermocouple 67 is provided so as to electrically connect the cold contact point 65 and the hot contact point 66 to each other. To the hot contact point 66, the infrared ray entering from the casing aperture 64 via the lens 62, for example, the infrared ray from a surface of the fixing belt 30 of the heating body 23 is entered and the thermopile 60 detects a surface temperature of the fixing belt 30 on the basis of an electromotive force generated by the thermocouples 67 due to a temperature difference between the cold contact point 65 and the hot contact point 66.

The environmental temperature sensor 61 is mounted to the lower face of the substrate 58 and is composed of, for example, a diode sensor of band cap type to detect a temperature of the thermopile 60 itself.

The lens 62 is provided below the thermopile 60 inside of the casing 57 and is disposed so as to optically focus the infrared ray entering into the casing 57 via the casing aperture 64 onto the hot contact point 66 of the thermopile 60.

Incidentally, the temperature detecting part 28 and the holding member 56 are disposed so that the holding member aperture 63 of the holding member 56 and the casing aperture 64 of the casing 57 correspond to the aperture 37 of the heat interrupting member 34. That is, the temperature detecting part 28 is disposed at a position at which the infrared ray radiated via the aperture 37 of the heat interrupting member 34 from the surface of the fixing belt 30 of the heating body 23 can be entered via the holding member aperture 63 and the casing aperture 64. The temperature detecting part 28 detects the surface temperature of the fixing belt 30 on the basis of the temperature detected by the thermopile 60 and the temperature detected by the environmental temperature sensor 61.

Figure 10:
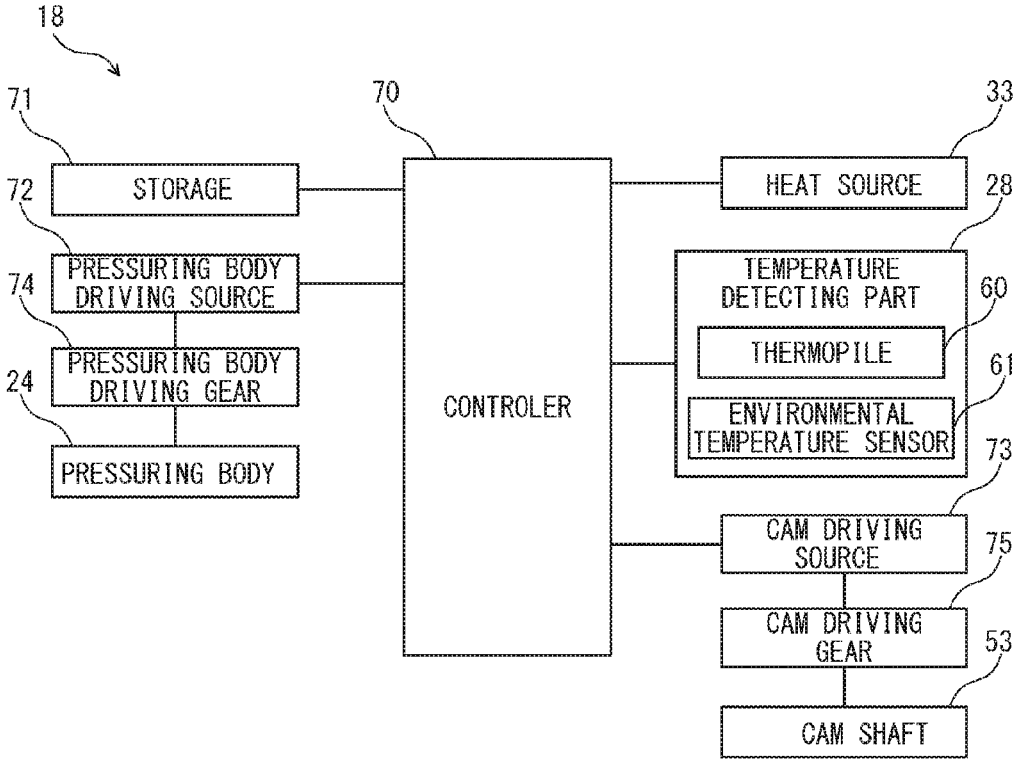
FIG. 10 is a block diagram showing a control system of the fixing device according to the embodiment of the present disclosure.

Next, a control system of the fixing device 18 will be described with reference to FIG. 10.

In the fixing device 18, the controller 70 composed of a CPU or the like is provided. The controller 70 is connected to storage 71 composed of a storage device, such as ROM or RAM. The controller 70 is configured to control each part of the fixing device 18 on the basis of control programs or control data stored in the storage 71. Alternatively, the control system of the fixing device 18 may utilize a controller (not shown) and a storage (not shown) constituting the control system of the printer 1 in place of the controller 70 and the storage 71.

The controller 70 is connected to a pressuring body driving source 72 composed of a motor or the like and the pressuring body driving source 72 is connected to the pressuring body 24 via a pressuring body driving gear 74. In addition, the pressuring body driving source 72 rotates the pressuring body 24 on the basis of a signal from the controller 70. If the pressuring body 24 is thus rotated, the fixing belt 30 of the heating body 23 brought into pressure contact with the pressuring body 24 is rotated in an opposite direction to the pressuring body 24 by following the rotation of the pressuring body 24. At this time, between the heating body 23 and the pressuring body 24, the fixing nip N is formed.

The controller 70 is connected to the heat source 33. In addition, when, on the basis of the signal from the controller 70, power is supplied to the heat source 33, the heat source 33 generates heat.

The controller 70 is connected to the thermopile 60 of the temperature detecting part 28. Into the thermopile 60, the infrared ray radiated from the surface of the fixing belt 30 of the heating body 23 is entered via the aperture 37 of the heat interrupting member 34, the holding member aperture 63 of the holding member 56 and the casing aperture 64 of the casing 57. The thermopile 60 of the temperature detecting part 28 detects the surface temperature of the fixing belt 30 in accordance with the infrared ray having been entered from the fixing belt 30 as described above.

The temperature detecting part 28 outputs the detected surface temperature value of the fixing belt 30 to the controller 70. Alternatively, the temperature detecting part 28 may output an electrical signal (a current value or a voltage value) corresponding to the surface temperature of the fixing belt 30 to the controller 70 and the controller 70 may calculate the surface temperature of the fixing belt 30 on the basis of the electrical signal.

The controller 70 is capable of controlling heating of the heat source 33 on the basis of the result of the detection by the temperature detecting part 28 as described above and setting the heating body 23 to a desired fixing temperature. At this time, if the sheet with an unfixed toner image passes through the fixing nip N, the unfixed toner image is heated and fused and the toner image is fixed onto the sheet.

In addition, the controller 70 is connected to the cam driving source 73 composed of a motor or the like and the cam driving source 73 is connected to the cam shaft 53 via the cam driving gear 75. Further, the cam driving source 73 rotates the cam shaft 53 on the basis of the signal from the controller 70.

In a configuration as described above, in a case where the heating body 23 is set to the pressurization state, as shown in FIG. 4, the cam shaft 53 is rotated to thereby orient the pressurization face 54 of the cam 47 of each moving mechanism 27 to the approaching direction side. In this manner, the pressurization face 54 of each cam 47 presses each cam abutment part 48 in the approaching direction, and then, each third frame 45 provided with each cam abutment part 48 and each coupling shaft 44 are moved in the approaching direction.

In accordance with the movement of each coupling shaft 44, each first coupling part 36 of the first frame 25 fastened to each coupling shaft 44 is also moved in the approaching direction, that is, the first frame 25 is moved in the approaching direction. Also, in accordance with the movement of the first frame 25, the heating body 23 mounted to the first frame 25 is also moved in the approaching direction. In this manner, the fixing belt 30 of the heating body 23 is brought into pressure contact with the pressuring body 24, and then, the heating body 23 and the pressuring body 24 are established in the pressurization state.

Figure 8:
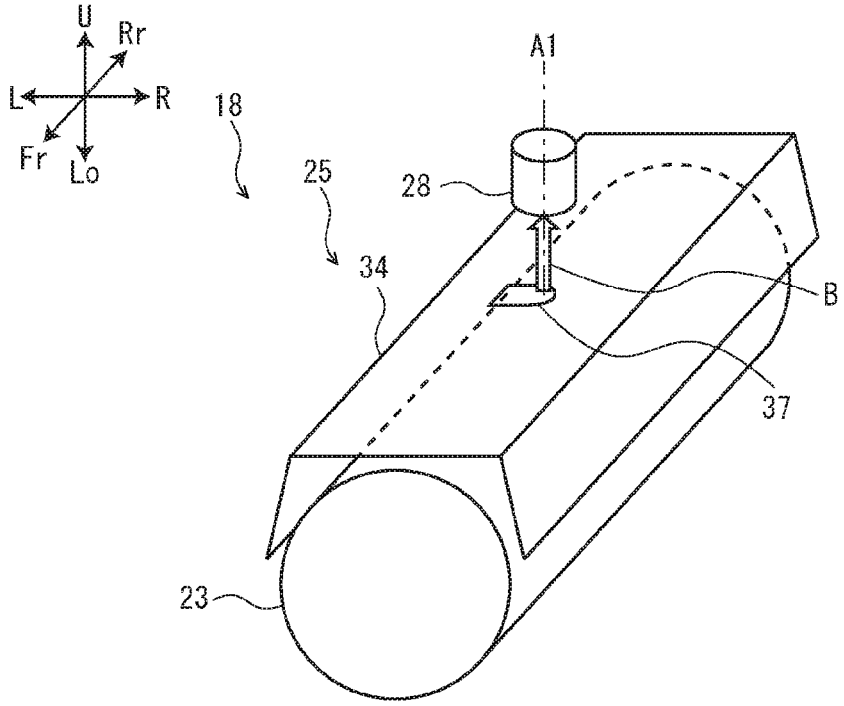
FIG. 8 is a perspective view showing the fixing device in the pressurization state according to the embodiment of the present disclosure.

Thus, in the first frame 25 when the heating body 23 is established in the pressurization state, the first position A1 of the heat interrupting member 34 corresponds to the detection range (field of view B) of the infrared ray by the temperature detecting part 28 and the aperture 37 is formed at the first position A1 of the heat interrupting member 34 (refer to FIG. 8). Therefore, a linear path of the infrared ray from the surface of the fixing belt 30 of the heating body 23 to the thermopile 60 of the temperature detecting part 28 is ensured by the aperture 37.

On the other hand, in a case where the heating body 23 in the pressurization state is switched to the depressurization state, as shown in FIG. 5, the cam shaft 53 is rotated to thereby orient the depressurization face 55 of the cam 47 of each moving mechanism 27 to the approaching direction side. In this manner, the pressurization face 54 of each cam 47 is rotated to the separating direction side and pressing against each cam abutment part 48 is released, and then, each cam abutment part 48 is moved in the separating direction together with the second frame 26 by a biasing member (not shown), such as a spring.

Accordingly, each third frame 45 provided with each cam abutment part 48 and each coupling shaft 44 are moved in the separating direction. In accordance with the movement of each coupling shaft 44, each first coupling part 36 of the first frame 25 fastened to each coupling shaft 44 is also moved in the separating direction, that is, the first frame 25 is moved in the separating direction. In addition, in accordance with the movement of the first frame 25, the heating body 23 mounted to the first frame 25 is also moved in the separating direction. In this manner, the fixing belt 30 of the heating body 23 is separated from the pressuring body 24, and then, the heating body 23 and the pressuring body 24 are established in the depressurization state.

Figure 9:
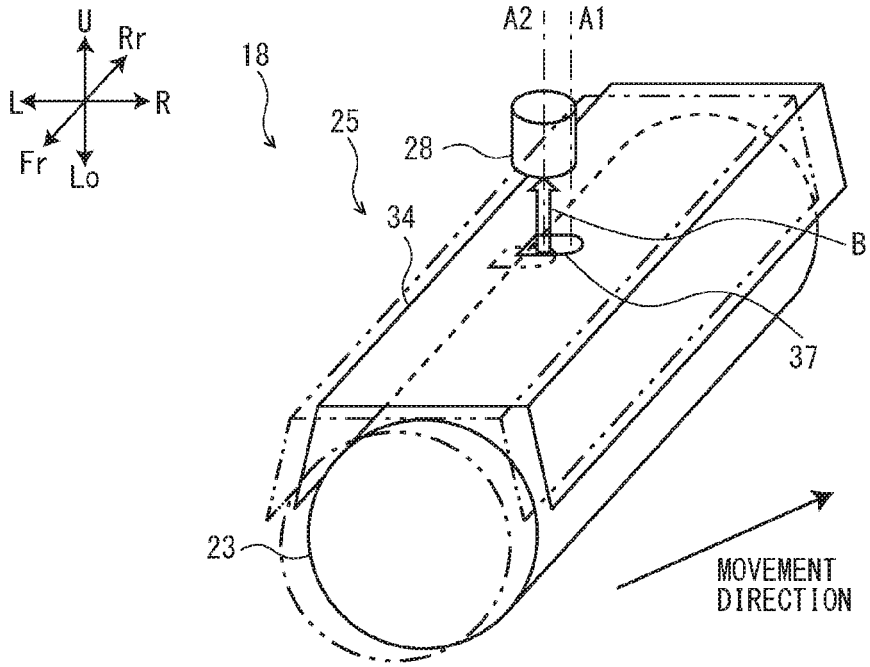
FIG. 9 is a perspective view showing the fixing device in the depressurization state according to the embodiment of the present disclosure.

Thus, in the first frame 25 when the heating body 23 is established in the depressurization state, the second position A2 of the heat interrupting member 34 corresponds to the detection range (field of view B) of the infrared ray by the temperature detecting part 28 and the aperture 37 is formed at the second position A2 of the heat interrupting member 34 (refer to FIG. 9). Therefore, a linear path of the infrared ray from the surface of the fixing belt 30 of the heating body 23 up to the thermopile 60 of the temperature detecting part 28 is ensured by the aperture 37.

In accordance with the embodiment, as described above, the fixing device 18 of the printer 1 (the image forming apparatus) includes the heating body 23, the pressuring body 24, the temperature detecting part 28, the first frame 25, the second frame 26 and the moving mechanism 27. In the heating body 23, the surface thereof is heated by the heat source 33. The pressuring body 24 is brought into pressure contact with the heating body 23 to thereby form the fixing nip N. The temperature detecting part 28 is arranged with respect to the heating body 23 in the noncontact manner, provided with the thermopile 60 (the infrared ray detecting element) detecting the infrared ray radiated from the surface of the heating body 23 and configured to detect the surface temperature of the heating body 23 on the basis of the result of the detection by the thermopile 60. The first frame 25 supports the heating body 23 in the rotatable state and includes the heat interrupting member 34 provided between the heating body 23 and the temperature detecting part 28 so as to cover the heating body 23. The second frame 26 supports the pressuring body 24 in the rotatable state. The moving mechanism 27 moves the first frame 25 in the approaching direction with respect to the second frame 26 to thereby establish the heating body 23 and the pressuring body 24 in the pressurization state. On the other hand, the moving mechanism 27 moves the first frame 25 in the separating direction with respect to the second frame 26 to thereby establish the heating body 23 and the pressuring body 24 in the depressurization state. The heat interrupting member 34 includes the aperture 37 having an elongated shape in the movement direction of the first frame 25. The aperture 37 causes the infrared ray radiated from the heating body 23 to pass therethrough to the thermopile 60.

According to this, since the aperture 37 of the heat interrupting member 34 has an elongated shape in the movement direction of the first frame 25, even if the first frame 25 is moved in order to switch pressurization or depressurization of the heating body 23, it is possible to cause the infrared ray from the heating body 23 to pass to the thermopile 60 via the aperture 37. Thus, the detection range (the field of view B) of the thermopile 60 is not concealed and it is possible to prevent mistaken detection of the temperature of the heating body 23 by the temperature detecting part 28. Therefore, since the controller 70 controlling the temperature of the heating body 23 is capable of setting the heating body 23 to a desired temperature, the heating body 23 is not overheated, and then, it is possible to avoid a danger of firing or the like from the heating body 23 or other components.

Also, in accordance with the embodiment, the aperture 37 is formed from the first position A1 of the heat interrupting member 34 corresponding to the detection range (field of view B) of the infrared ray by the temperature detecting part 28 when the heating body 23 is established in the pressurization state up to the second position A2 of the heat interrupting member 34 corresponding to the detection range (field of view B) of the infrared ray by the temperature detecting part 28 when the heating body 23 is established in the depressurization state. According to this, it is possible to cause the infrared ray from the heating body 23 to securely pass to the thermopile 60 via the aperture 37.

In addition, in accordance with the embodiment, the aperture 37 is formed in a U-shape having a bottom part 38 at the first position A1 of the heat interrupting member 34. According to this, with a simple construction of the aperture 37, it is possible to reliably prevent the heat interrupting member 34 from concealing the detection range (the field of view) of the thermopile 60.

Figure 11:
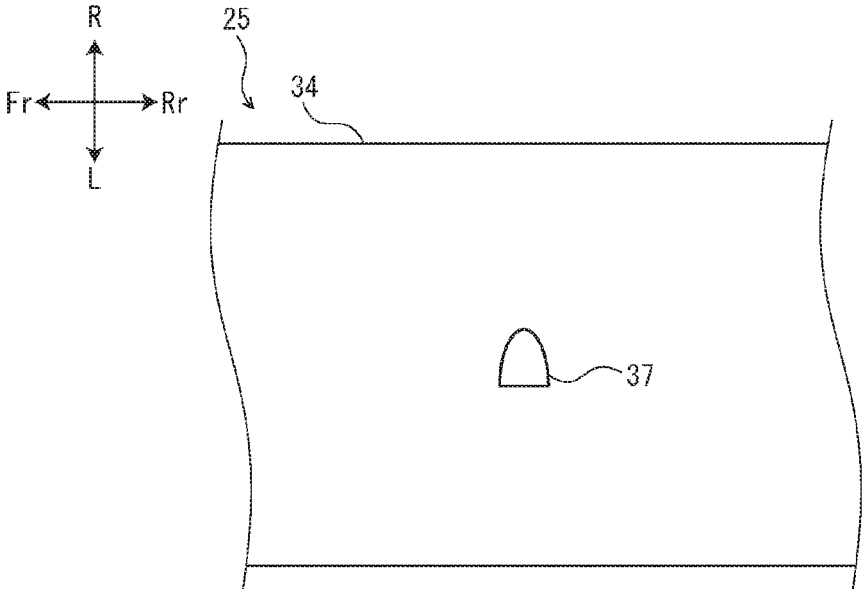
FIG. 11 is a plan view showing a heat interrupting member of a fixing device according to another embodiment of the present disclosure.

Although the embodiment was described as to a construction in which the aperture 37 of the heat interrupting member 34 of the first frame 25 is formed in the U-shape having the bottom part 38 at the first position A1 of the heat interrupting member 34, the shape of the aperture 37 is not limited to this construction. For example, in another embodiment, the aperture 37 may be formed, as shown in FIG. 11, in an elliptical shape extending from the first position A1 up to the second position A2 of the heat interrupting member 34. According to this, with the simple construction of the aperture 37, it is possible to reliably prevent the heat interrupting member 34 from concealing the detection range (the field of view B) of the thermopile 60.

Although the embodiment was described as to a construction in which, in a case where the first frame 25 is configured to move at least in the left and right directions (the sheet conveyance direction) with respect to the second frame 26, the aperture 37 of the heat interrupting member 34 of the first frame 25 has an elongated shape in left and right directions and is formed to penetrate upwardly and downwardly on the upper face of the heat interrupting member 34, the shape of the aperture 37 is not limited to this construction. For example, in another embodiment, in a case where the temperature detecting part 28 is disposed at the left side or the right side of the heating body 23 and the first frame 25 is configured to move at least in the upward and downward directions with respect to the second frame 26, it may be that the aperture 37 has an elongated shape in the upward and downward directions and is formed to penetrate leftwardly and rightwardly on the left side face or the right side face constituting the heat interrupting member 34.

Although the embodiment was described as to a case in which the heating body 23 is composed of the fixing belt 30, in another embodiment, the heating body 23 may be composed of a heating roller.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a heating body, of which surface is heated by a heat source;

a pressuring body brought into pressure contact with the heating body to form a fixing nip;

a temperature detecting part arranged with respect to the heating body in a noncontact manner, provided with an infrared ray detecting element detecting an infrared ray radiated from the surface of the heating body and configured to detect surface temperature of the heating body on the basis of a result of detection by the infrared ray detecting element;

a first frame configured to support the heating body in a rotatable state and to include a heat interrupting member provided between the heating body and the temperature detecting part so as to cover the heating body;

a second frame configured to support the pressuring body in a rotatable state; and a moving mechanism configured to move the first frame in an approaching direction with respect to the second frame to establish the heating body and the pressuring body in a pressurization state and to move the first frame in a separating direction with respect to the second frame to establish the heating body and the pressuring body in a depressurization state, wherein the heat interrupting member includes an aperture having an elongated shape in a movement direction of the first frame and causing the infrared ray radiated from the heating body to pass therethrough to the infrared ray detecting element.

2. The fixing device according to claim 1, wherein the aperture is formed from a first position of the heat interrupting member corresponding to a detection range of the infrared ray by the temperature detecting part when the heating body is in the pressurization state up to a second position of the heat interrupting member corresponding to a detection range of the infrared ray by the temperature detecting part when the heating body is in the depressurization state.

3. The fixing device according to claim 2, wherein the aperture is formed in a U-shape having a bottom part at the first position.

4. An image forming apparatus comprising the fixing device according to claim 3.

5. The fixing device according to claim 2, wherein the aperture is formed in an elliptical shape extending from the first position up to the second position.

6. An image forming apparatus comprising the fixing device according to claim 5.

7. An image forming apparatus comprising the fixing device according to claim 2.

8. The fixing device according to claim 1, further comprising:

a holding member, inside which the temperature detecting part is mounted, positioning the temperature detecting part with respect to the heating body in a noncontact manner, wherein the holding member has a holding member aperture at the heating body side and the holding member aperture is disposed so as to correspond to the aperture.

9. An image forming apparatus comprising the fixing device according to claim 8.

10. The fixing device according to claim 1, wherein the moving mechanism includes a biasing member configured to bias the first frame so as to be draw the first frame to the second frame and a cam configured to move the first frame in the approaching direction or the separating direction in accordance with rotation.

11. An image forming apparatus comprising the fixing device according to claim 10.

12. An image forming apparatus comprising the fixing device according to claim 1.

* * * * *